United States Patent [19]

Wittmann

[11] 4,395,054

[45] Jul. 26, 1983

[54] SKI BRAKE

[75] Inventor: Heinz Wittmann, Vienna, Austria

[73] Assignee: TMC Corporation, Baar, Switzerland

[21] Appl. No.: 272,620

[22] Filed: Jun. 11, 1981

Related U.S. Application Data

[63] Continuation of Ser. No. 46,553, Jun. 7, 1979, abandoned.

[30] Foreign Application Priority Data

Jun. 22, 1978 [AT] Austria ..... 4533/78

[51] Int. Cl.[3] ..... A63C 7/10

[52] U.S. Cl. ..... 280/605

[58] Field of Search ..... 280/605; 188/5, 7

[56] References Cited

U.S. PATENT DOCUMENTS

| | | | |
|---|---|---|---|
| 3,989,271 | 11/1976 | Riedel | 280/605 |
| 4,078,824 | 3/1978 | Riedel | 280/605 |
| 4,101,145 | 7/1978 | Korger | 280/605 |
| 4,116,461 | 9/1978 | Krob et al. | 280/605 |
| 4,123,083 | 10/1978 | Riedel | 280/605 |
| 4,128,256 | 12/1978 | Weigl | 280/605 |
| 4,194,758 | 3/1980 | Svoboda et al. | 280/605 |

FOREIGN PATENT DOCUMENTS

| | | | |
|---|---|---|---|
| 2531995 | 2/1976 | Fed. Rep. of Germany | 280/605 |
| 2532736 | 2/1977 | Fed. Rep. of Germany | 280/605 |
| 2535552 | 2/1977 | Fed. Rep. of Germany | 280/605 |
| 2715425 | 10/1978 | Fed. Rep. of Germany | 280/605 |
| 2833259 | 3/1979 | Fed. Rep. of Germany | 280/605 |
| 2309255 | 11/1976 | France | 280/605 |
| 2330419 | 6/1977 | France | 280/605 |

*Primary Examiner*—David M. Mitchell

*Attorney, Agent, or Firm*—Flynn, Thiel, Boutell & Tanis

[57] ABSTRACT

A ski brake having two braking legs, which in the braking position project next to the two ski edges below the running surface of the ski. The braking legs are the free ends of at least one braking bar which is formed preferably of a spring wire by being bent and curved, which braking bar can be swung against a vertically acting spring force of return spring which is produced when a ski boot or a sole plate urges the ski brake from the braking position into a retracted position, in which position the two braking legs are supported lying approximately parallel with respect to and above the upper surface of the ski, which vertical force is diverted by guide means substantially at a right angle with respect to the longitudinal axis of the ski and thus the braking bars are either spread apart or pulled in.

10 Claims, 12 Drawing Figures

SKI BRAKE

This is a continuation, of application Ser. No. 46 533, filed June 7, 1979 and now abandoned.

FIELD OF THE INVENTION

This invention relates to a ski brake and, more particularly, to a ski brake wherein the brake legs are movable to a position overlying the upper surface of the ski when the ski brake is in the retracted position.

BACKGROUND OF THE INVENTION

Such a ski brake is generally known from German OS No. 2 517 838. A force which is applied vertically onto the ski brake loads in this construction an arced stepping bar, which is hinged in the area of the upper end of the braking member to the braking member. A pivot or swivel point is associated with the braking member as an abutment.

This construction at the same time permits one to recognize the disadvantages, wherein due to the small possible spreading of the braking members at their upper ends, only an extremely small pulling in of the braking legs is possible. The braking legs will lie only partly within the ski edges and the ends of the braking members which are remote from the braking legs lie totally outside of the edges of the ski.

Also it is known according to German OS No. 2 517 820 to load the part of the braking members, which is used for the support, in a direction toward the longitudinal axis of the ski. Just like in the aforedescribed construction, it is here also not possible to totally pull the braking legs in above the edges of the ski. The upper ends of the braking members are thereby always outside of the edges of the ski, which can during downhill skiing cause an undesired catching of the ski on obstacles which project from the ground.

The invention has as an object a design of a ski brake of the above-mentioned type such that all structural parts of the ski brake are in the retracted position above the upper surface of the ski and within the edges of the ski.

The set purpose is inventively attained by the guide means being formed by two guide surfaces which are each positioned at an angle with respect to the longitudinal axis of the ski, which guide surfaces are provided on a control part or a pipelike sleeve.

The inventive guide means for converting the vertical force into a force which is substantially at a right angle with respect to the longitudinal axis of the ski assures a very large pulling-in movement. Also during downhill skiing, no structural parts project beyond the side edges of the ski.

BRIEF DESCRIPTION OF THE DRAWINGS

Further advantages, details and characteristics of the invention will be described more in detail hereinafter with reference to two exemplary embodiments and with reference to the drawings, in which.

DETAILED DESCRIPTION

Figure 1:
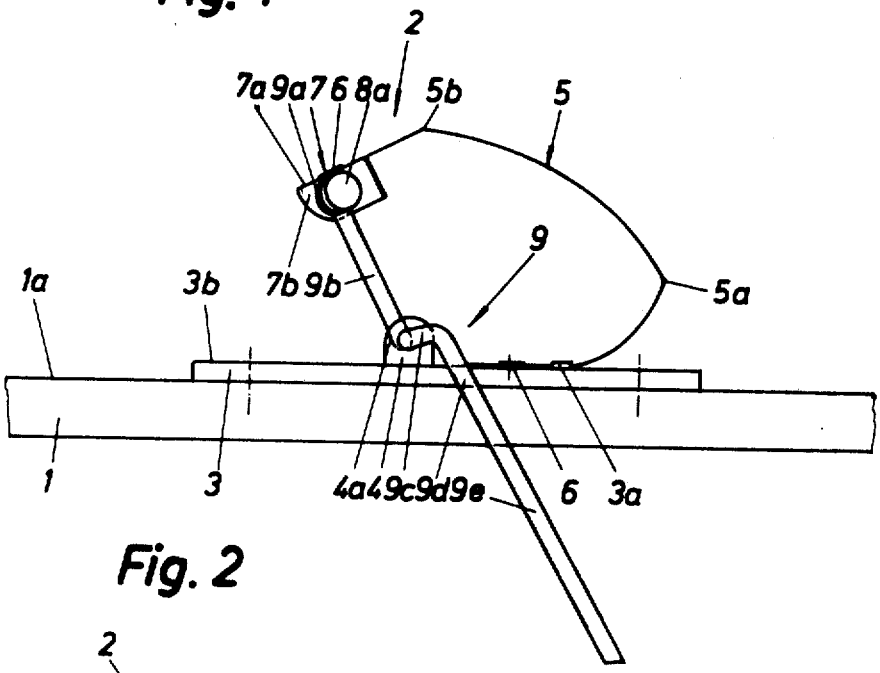
FIG. 1 illustrates a side view of an inventive ski brake in the braking position.

A rectangular base plate 3 of uniform thickness is fastened to the ski 1 by means of four screws (only the center lines have been indicated) arranged in the region of the corners of the base plate 3. The base plate 3 is designed slightly more narrow than the width of the ski 1. As can be seen in the top view according to FIG. 2, a bearing plate 4 with a circular upper contour **4*a* is provided approximately in the longitudinal center and on each side of the base plate 3. The two bearing plates 4 are thereby arranged on the base plate 3 such that they form in direction toward the tip of the ski (arrow Pf) an opening or diverging angle. Furthermore the bearing plates 4** are positioned symmetrically with respect to the longitudinal axis of the ski.

Approximately in the center between the two bearing plates 4 and the rear end of the base plate 3, an elongated holding bar **3*a* is fastened with its longitudinal axis extending perpendicular with respect to the longitudinal axis of the ski on the upper side 3*b* of the base plate 3. The holding bar 3*a* is rectangular in cross section and is substantially half as wide (or long) as the width of the base plate 3. It grips over a spring-steel band 5, which will be described more in detail below, in the region of its end engaging the base plate 3**.

The spring-steel band 5 has a rectangular design of uniform thickness, and two bent sections **5*a*, 5*b*. The terminial end of the spring-steel band 5, which end is associated with the base plate 3, extends in a direction toward the tip of the ski in front of the holding bar 3*a* and is fastened thereat to the base plate 3 by two rivets 6 arranged symmetrically with respect to the longitudinal axis of the ski. The other end of the spring-steel band 5 is riveted by means of two further rivets 6 to a control part 7**. These further rivets lie also symmetrically with respect to the longitudinal axis of the ski. The control part will yet be described more in detail.

The control part 7 is an elongated member, the longitudinal axis of which is arranged perpendicular with respect to the longitudinal axis of the ski. Its longitudinal ends form supports **7*b* which face the ski edges and are bent at a right angle in direction toward the base plate 3 so that they form an opening or diverging angle in direction toward the tip of the ski. The rearwardly facing corner between the bottom edge and rear edge of the supports 7*b* are constructed at a right angle. The opposite frontwardly facing corner has a radius. The supports 7*b* have the same thickness as the control part 7**.

The spring-steel band 5 is riveted to the control part 7 on its upper side **7*a***, and terminates flush with the side edge of the control part facing the tip of the ski.

Each of the two supports **7*b* of the control part 7 carries approximately in its center, on the side thereof facing the ski edges, a cylindrical pin 8, the axis of which extends perpendicularly away therefrom. The two pins 8 have cylindrical heads 8***a*. The pins 8 also have cylindrical sleeves 9*a* encircling same. The cylindrical sleeves are secured to the ends of braking bars associated with the control part 7. Through this type of support, it is possible for the braking bar 9 to swivel only in one plane perpendicular with respect to the cylindrical pin 8.

Figure 2:
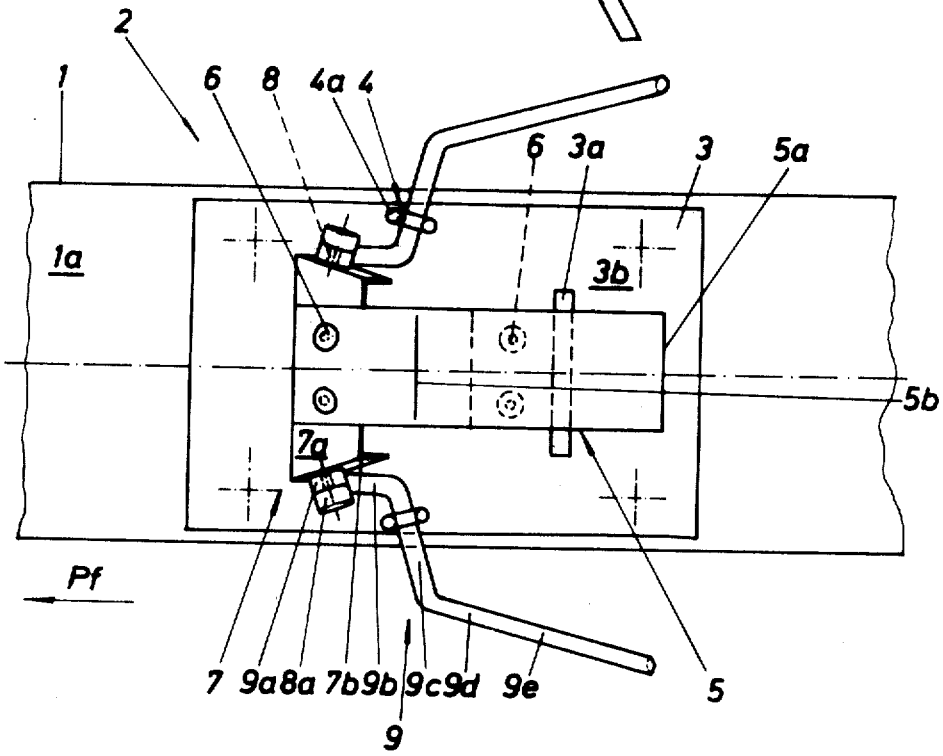
FIG. 2 is a top view of FIG. 1.

The braking bars 9 have, starting from the cylindrical sleeves 9*a*, a straight segment 9*b*. Each straight segment 9*b* is followed by a first outwardly angled segment 9*c* in direction toward the ski edges. Furthermore the first outwardly angled segment 9*c* projects from the plane defined by the longitudinal axis of the straight segment 9*b* and the axis of the pins 8 in direction toward the tail of the ski and upwardly away from the upper surface of the ski. In the region of the first segment 9*c*, the braking bar 9 extends through openings and, thence, is pivotally supported on the bearing plates 4. The circular contour 4*a* of the bearing plate 4 makes it possible for the braking bar 9 in the region where the bearing plate 4 is gripped around by the braking bar 9, to swing also into positions wherein the braking bar is not positioned perpendicularly on the bearing plate 4. In other words, the pivotal support is something like a universal joint. A second angled segment 9*d* follows the first segment 9*c*, the length of which corresponds approximately with the extent of the spring-steel band 5. The second segment 9*d* forms with the first segment 9*c* approximately an angle of 70° to 80° and defines the braking legs 9*e* of the ski brake. As a result, it is achieved that the braking bar 9 in the braking position of the ski brake 2, as illustrated in FIGS. 1 and 2, extends away from the ski. Furthermore, the second segment 9*d* extends in the same direction as the straight segment 9*b*.

The exemplary embodiment which is illustrated in FIGS. 1 and 2 illustrates the inventive ski brake 2 in the braking position. The upper surface 7*a* of the control part 7 is thereby held by the spring-steel band 5 in a position which is generally perpendicular to the straight segment 9*b* of the braking bar 9. Thus the greatest possible spreading of the braking legs 9*e* is achieved. If the control part 7 is swung counterclockwise by a not illustrated ski boot in direction toward the base plate 3, the control part 7 also swings slightly in the clockwise direction about the axis of the pin 8. The now sloped position of the surface 7*a* and supports 7*b* effects a slight, continuous pulling in of the braking legs 9*e*.

Figure 3:
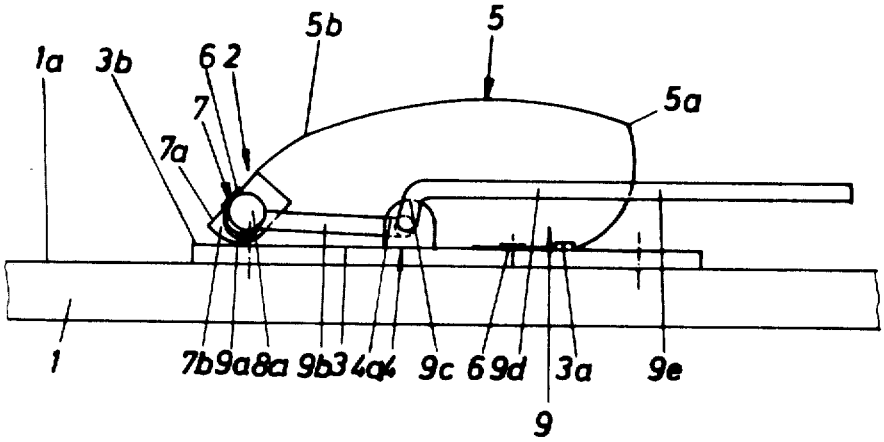
FIG. 3 illustrates a side view of the ski brake in the swung-down condition prior to a pulling in of the brake legs.
Figure 4:
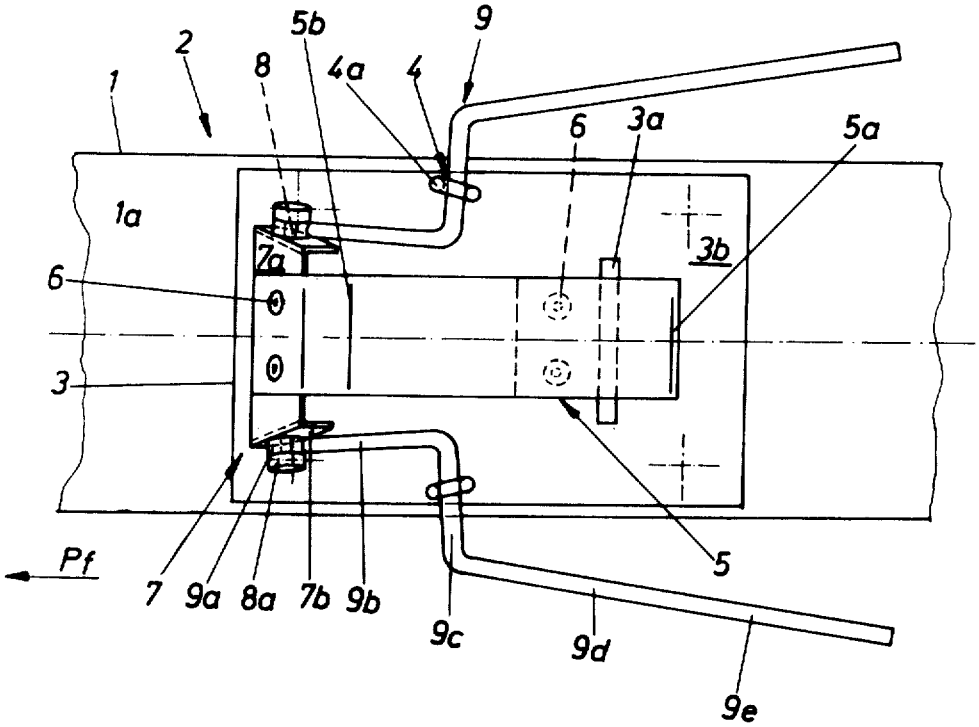
FIG. 4 is a top view of FIG. 3.

In the position as is illustrated in FIGS. 3 and 4, thus prior to an actual pulling in of the braking legs 9*e*, the braking bars 9 are already totally above the upper surface 1*a* of th ski 1 and above the upper surface 3*b* of the base plate 3.

Figure 5:
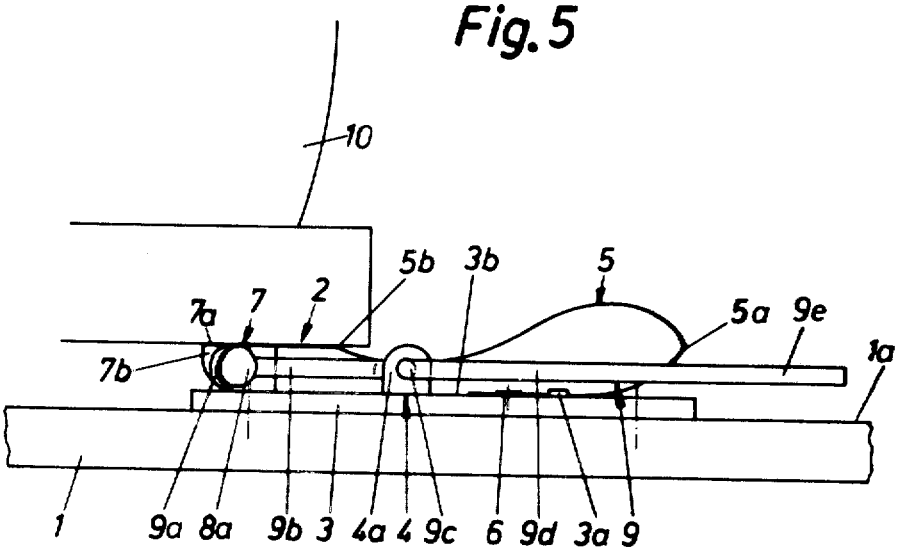
FIG. 5 is a side view of the ski brake in the retracted position.
Figure 6:
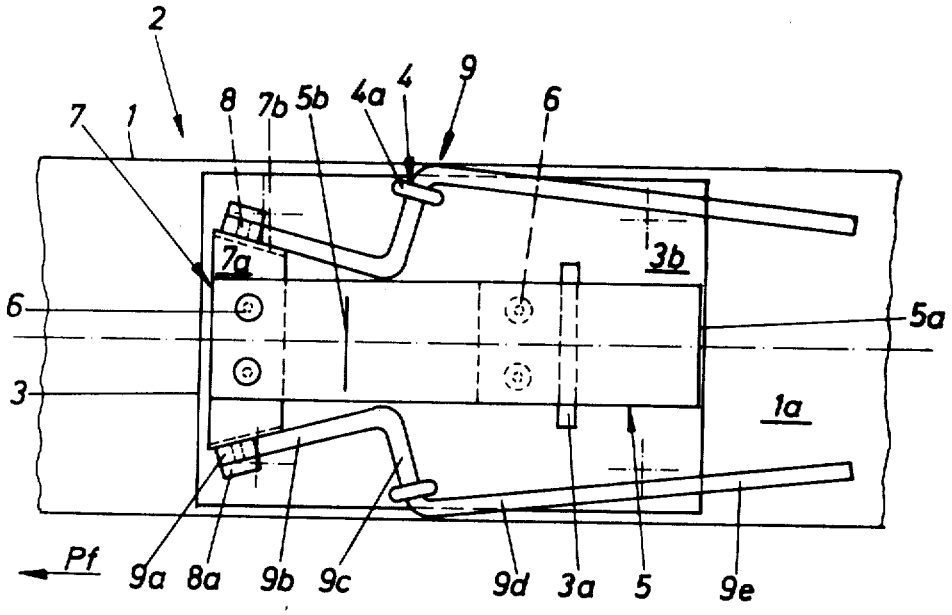
FIG. 6 is a top view of FIG. 5.

If the control part 7 is further loaded by a ski boot 10 (compare FIG. 5), then it swings in the clockwise direction until its upper surface 7*a* will lie approximately parallel with respect to the upper surface 3*b* of the base plate 3. This movement will cause the braking bars 9 to be pulled inwardly of the ski edges not separately identified. The spring-steel band 5 has in the position according to FIGS. 5 and 6 its strongest possible spring force.

If the ski boot 10 becomes disengaged from the ski binding and removed from the control part 7, the spring-steel band 5 will swing the control part 7 counterclockwise immediately into the position according to FIGS. 3 and 4. Through this swinging movement, the braking legs 9*e* will be swung outwardly beyond the ski edges. Thereafter, the spring-steel band 5 will swing the ski brake 2 upwardly into the position according to FIGS. 1 and 2. The ski brake 2 is now again in the braking position and is held by the spring-steel band 5 in this position.

In the exemplary embodiment according to FIGS. 7 to 12, a substantially rectangular base plate 3' is also fastened to a ski 1 by means of schematically indicated screws arranged in the region of the corners. An elongated approximately rectangular and upstanding support 3*c* is formed in the region of the front end, that is the end which faces the tip of the ski (arrow Pf), of the base plate 3', the longitudinal axis of which extends perpendicularly with respect to the longitudinal axis of the ski. The height of the support 3*c* is approximately as great as the thickness of the base plate 3'.

The base plate 3' carries approximately in its longitudinal center an elongated bearing member 4', the longitudinal axis of which extends perpendicular to and symmetrical about the longitudinal axis of the ski. The width of the bearing member 4' is approximately half the width of the base plate 3'. The bearing member 4' has furthermore a cylindrical opening 4*b* therethrough. The cylindrical opening 4*b* serves to pivotally support a hollow pipelike sleeve 11, the longitudinal extent of which must be approximately as large, as the width of the ski 1. The two opposite ends 11*a*, 11*b* of the sleeve 11 have a shape which differs from a plane surface and which will be yet described in more detail. The sleeve 11 has a diameter which will also be described in more detail.

Two axially aligned and separate axles 12 are provided on a braking bar 9' which is formed in one piece and is made of spring-steel wire. Each axle 12 is received in an end region 11*a*, 11*b* of the hollow pipelike sleeve 11, the length of each axle being slightly less than the distance to the bearing member 4' from the associated edge of the base plate 3'. The braking bar 9' is designed such that its side segments are straight approximately over two-thirds of their length and form the braking legs 9'*e*. These are, starting out from the axles 12, provided in direction toward the tail of the ski. The braking legs 9'*e* extend in the braking position of the ski brake 2' approximately parallel with respect to the side surface edges of the ski 1. Starting out from the axles 12 in a direction toward the tip of the ski, the braking bar 9' has an upwardly tapering part 9*h* and subsequently transfers over into an approximately semicircular curved segment 9*f*. The radius of the semicircular curved segment 9*f* of corresponds approximately to the distance between the bearing member 4' and the side edge of the ski 1. The semicircular curved segments 9*f* are followed also by a radiused segment and a straight connecting segment 9*g*, the longitudinal axis of which extends substantially perpendicular to and symmetrical with the longitudinal axis of the ski. Starting approximately at the midpoint of the curved segments 9*f*, an inner portion of the curved segments 9*f* and the connecting segment 9*g* connecting them project in the non-operated position of the braking bar 9' away from the plane of the braking bar 9' at an angle $\theta$ of approximately 35° to 40° (see FIG. 9), which angle opens up in direction toward the tail of the ski. Through the curved segments 9*f* and the arrangement of the connecting segment 9*g*, the braking bar 9' has an initial spring force which urges the braking legs 9'*e* in a direction toward the center of the ski.

The hollow pipelike sleeve 11 carries a substantially rectangular operating bar 13, which in the braking position of the ski brake 2' is positioned almost perpendicularly to the upper surface 1*a* of the ski 1. The operating bar 13 is designed sufficiently wide that it grips beyond the lateral ends of the bearing member 4'.

Figure 7:
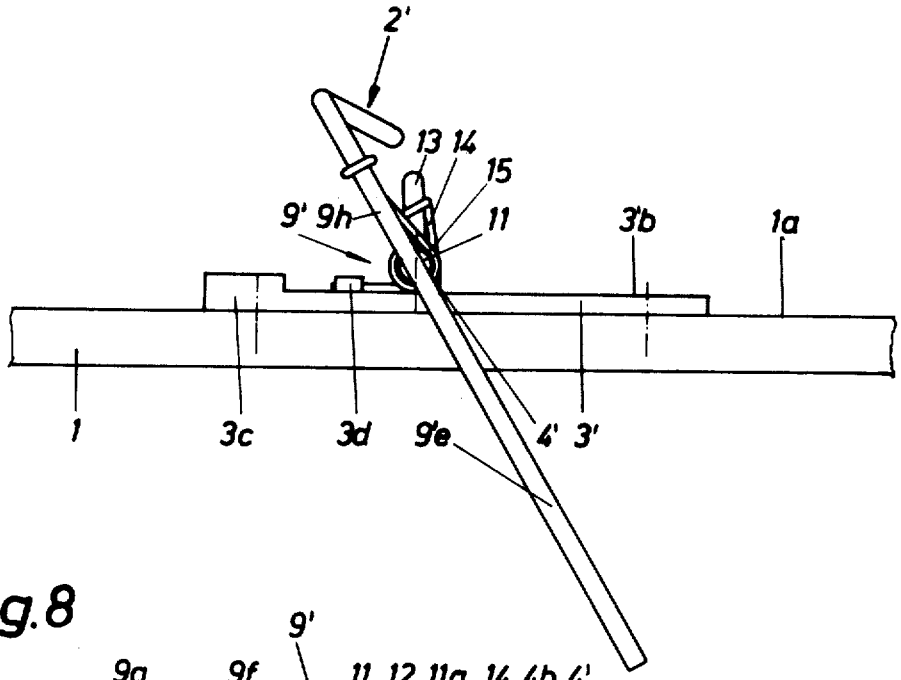
FIG. 7 is a side view of a different exemplary embodiment of an inventive ski brake in the braking position.

The tapering part 9*h* of the ski brake 2' and the operating bar 13 define in the braking position of the ski brake 2' according to FIG. 1 an angle of approximately 30° (see FIG. 7). On one side of the operating bar 13 associated with an end region 11*a* of the hollow pipelike sleeve 11, a torsion spring 14 encircles the pipelike sleeve 11. One end of the torsion spring 14 encircles a leg on the operating bar 13. The other end of the torsion spring 14 encircles the associated, tapering agent 9*h* of the braking bar 9'. The torsion spring 14 continually attempts to form an angle of approximately 30° between the tapering part 9*h* of the braking bar 9' and the operating bar 13.

The two end regions 11*a*, 11*b* of the sleeve 11 each have a cam surface 11*c* and a recess or notch 11*d*, which are arranged such that the cam surfaces 11*c* spread apart the braking legs 9'*e* in the upright position of the operating bar 13 so that the legs 9'*e* will lie outside of the lateral edges of the ski 1. If the operating bar 13 is swung in the counterclockwise direction into the plane of the braking legs 9'*e*, the braking legs 9'*e* will lie at the end region 11*a*, 11*b* of the sleeve in an aligned position with the recesses 11*d*. The recesses 11*d* are constructed such that the braking legs 9'*e* terminate flush with the cam surfaces 11*c*, so that the entirety of each of the braking legs 9'*e* will lie inside the lateral edges of the ski 1.

The hollow pipelike sleeve 11 has such a large inside diameter, that the separate axles 12, which are rigidly connected to the braking legs 9'*e*, are not hindered during a swinging movement of the braking legs 9'*e* from a position outside of the lateral edges of the ski 1 into a position within the lateral edges of the ski 1.

A further tension spring 15 is provided opposite of the torsion spring 14 also on the sleeve 11. The torsion spring 15 grips with one leg around the tapering part 9*h* of the braking bar 9' and is supported with the other leg on the base plate 3'. The just described leg of the torsion spring 15 is prevented from lifting off from the base plate 3' by a substantially rectangular holding block 3*d* which is arranged on the upper surface 3'*b* of the base plate 3'. The torsion spring 15 loads the braking bar 9' in clockwise direction. The force which is applied by the torsion spring 15 onto the structural parts which are associated with the torsion spring 15 is substantially less than the force, which is applied by the torsion spring 14 onto the structural parts associated with said torsion spring 14. As a result, first the operating bar 13 and only subsequently the braking bar 9' is swung upwardly, so that the two braking legs 9'*e* will not get caught on the upper surface 1*a* of the ski 1.

Due to the fact that the torsion springs 14, 15 grip around the braking bar 9' or the operating bar 13 or are held on the base plate 3' by a holding block 3*c*, they also simultaneously function as a resilient stop.

If the braking bar 9' is stepped down upon in the area of the semicircular curved segment 9*f* or of the straight connecting segment 9*g* by a ski boot 10, the braking bar will swing counterclockwise until it rests on the support 3*c* of the base plate 3'. The operating bar 13 and the pipelike sleeve 11 which is connected rigidly to the operating bar are swung along by the torsion spring 14 and no relative movement at all is created between the braking bar 9', pipelike sleeve 11, operating bar 13 and the torsion spring 14. There still exists a space between the ski boot 10 and the operating bar 13, that is, up to this point in time only the braking bar 9' has been operated or contacted by the ski boot 10 (compare FIG. 9).

During a further stepping down of the ski boot 10, the straight connecting segment 9*g* is swung clockwise into the plane of the braking bar 9'. Also into the plane of the braking bar 9', however, counterclockwise, the operating bar 13 is swung against the force of the torsion spring 14. By swinging the operating bar 13 in the counterclockwise direction, the cam surfaces 11*c* of the sleeve 11 slide off from the braking legs 9'*e*, so that the braking legs 9'*e* which are under initial tension will lie in the recesses 11*d* in the end regions 11*a*, 11*b* of the sleeve 11. Due to the position change of the braking legs 9'*e* from the position on the cam surfaces 11*c* into the position in the recesses 11*d*, it is also achieved that the braking legs 9'*e* swing in a direction toward the center of the ski, that the braking legs 9'*e* will lie with their entire length within the lateral edges of the ski 1, as this can be recognized from FIGS. 11 and 12.

Figure 8:
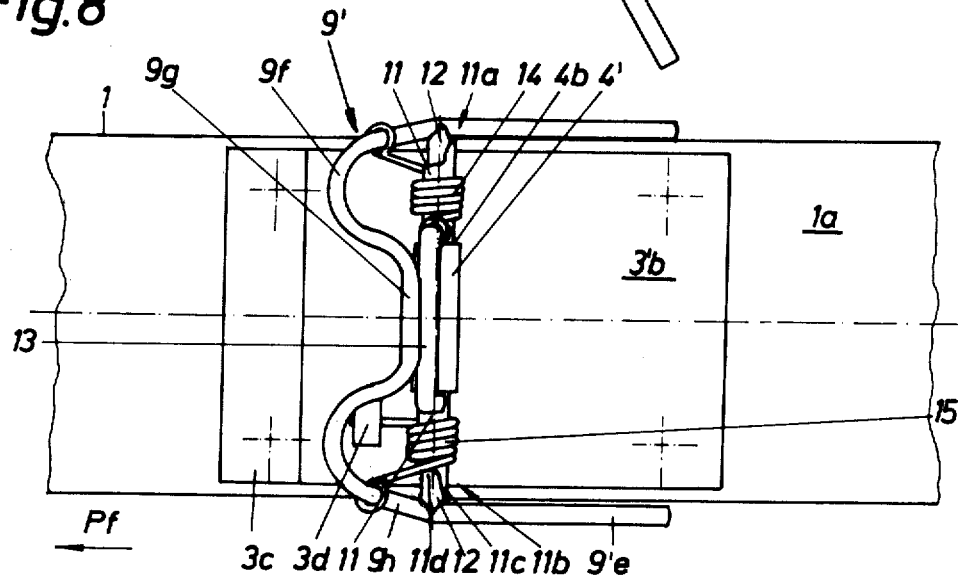
FIG. 8 is a top view of FIG. 7.
Figure 9:
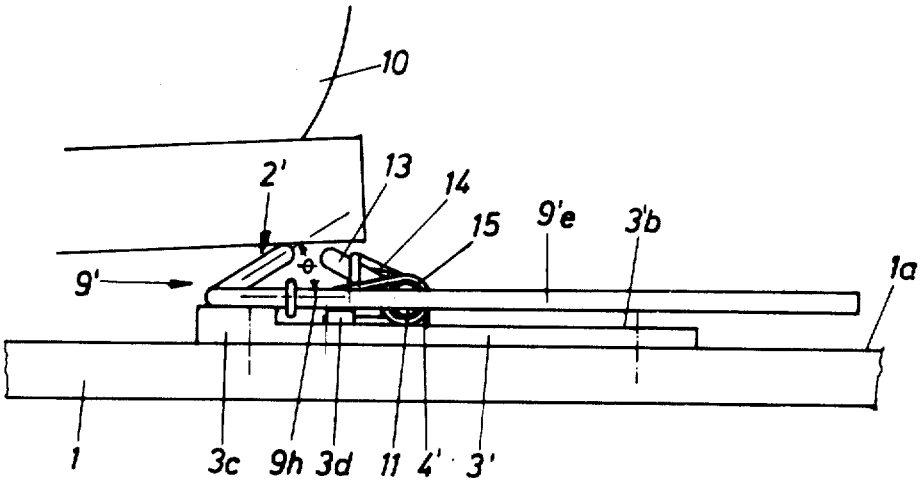
FIG. 9 illustrates the ski brake in stepped-down condition prior to a pulling in of the brake legs.
Figure 10:
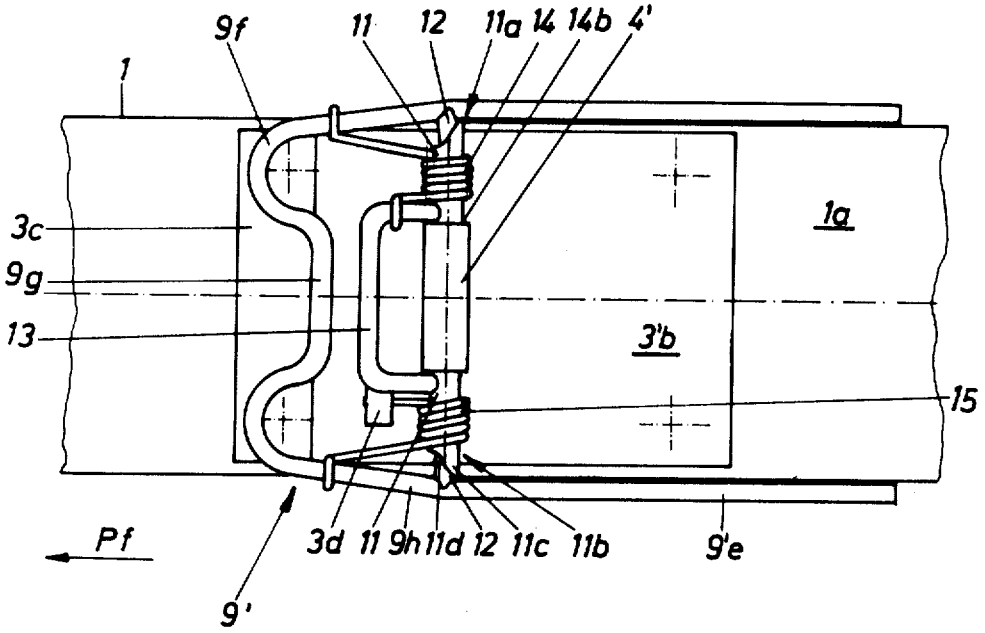
FIG. 10 is a top view of FIG. 9.
Figure 11:
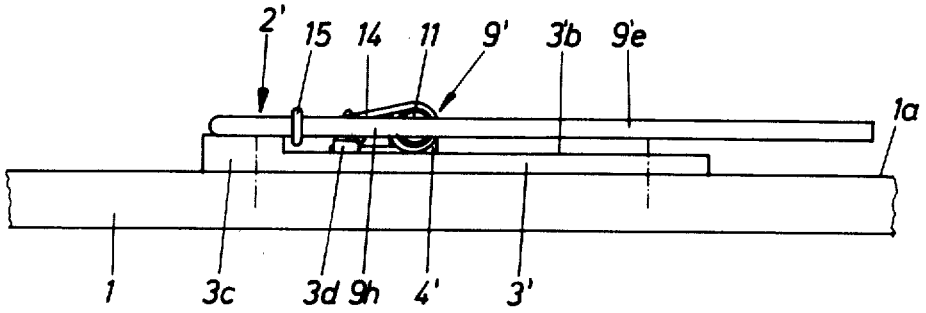
FIG. 11 is a side view of the inventive ski brake in the retracted position with pulled-in braking legs.
Figure 12:
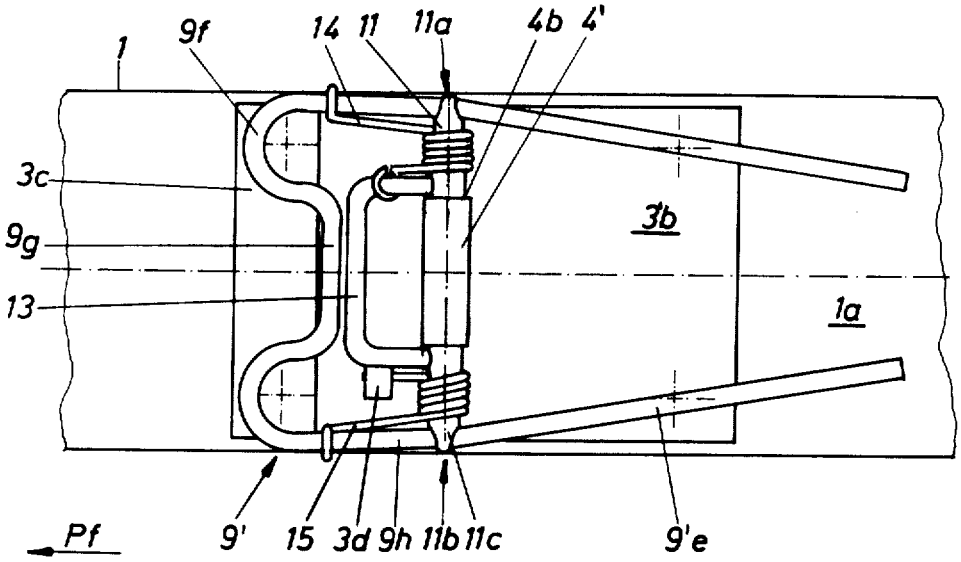
FIG. 12 is a top view of FIG. 11.

If the ski boot 10 disengages from the braking bar 9' and the operating bar 13, be it arbitrarily by stepping out of a ski binding (not illustrated) or automatically due to a fall, the following happens:

The two torsion springs 14 and 15 will attempt to relax and assume the position illustrated in FIGS. 7 and 8. Since the torsion spring 14 which loads the operating bar 13 is designed stronger than the torsion spring 15 which loads the braking bar 9', the first working stage consists of the operating bar 13 and the sleeve 11 according to FIGS. 9 and 10 swivelling to a position approximately 30° with respect to the braking bar 9'.

This causes the cam surfaces 11*c* to engage the braking legs 9'*e* and effect a spreading of these legs beyond the edges of the ski 1. Approximately when this working stage has been carried out, the weaker torsion spring 15 will swing the braking bar 9' in a clockwise direction into the braking position according to FIGS. 7 and 8. During this working stage, the straight connecting segment 9*g* of the braking bar 9' is also swung into its relaxed position.

The two torsion springs 14 and 15 which load the operating bar 13 and the braking bar 9' form at the same time also an elastic stop for the just mentioned structural parts, because they always want to assume a position according to FIGS. 7 and 8.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A ski brake for use on a ski, comprising:

a base plate adapted to be mounted on said ski;

bearing means on said base plate;

a pair of laterally spaced brake arms pivotally and laterally slidably mounted on said bearing means, each of said brake arms having a brake leg portion and a pedal portion, said brake arms each being pivotal between (1) a braking position wherein said brake leg portions project beneath the running surface of said ski and said pedal portion extends upwardly inclined to the upper surface of said ski and (2) a retracted position wherein said brake leg portions and said pedal portion extend above said upper surface of said ski;

a control part and pivotal securement means pivotally securing said control part to said pedal portions of each of said brake arms, said pivotal securement means effecting, upon a pivotal movement of said control part relative to said pedal portions between an initial position wherein said brake arms are positioned in their laterally outermost position and a final position wherein said brake arms are positioned in their laterally innermost position, a laterally inward movement of said brake arms, said control part including a generally inverted U-shaped member having a bight portion with an upwardly facing surface and a pair of downwardly extending support legs at the lateral edges of said bight portion, said support legs being formed at a right angle to said bight portion and opening at a diverging angle away from the free ends of said brake leg portions, said pivotal securement means effecting said pivotal coupling about an axis that is normal to the plane of said support legs; and resilient means effecting an erection of said brake arms to said braking position and a simultaneous urging of said control part to said initial position thereof to urge said brake arms to their said initial position thereof.

2. The ski brake according to claim 1, wherein each of said support legs has an elongated axle pin thereon, the axis of which extends normal to said plane of said support leg, wherein each of said pedal portions has bearing means thereon receiving an axle pin therein.

3. The ski brake according to claim 2, wherein said bearing means on each of said pedal portions is a cylindrical sleeve.

4. The ski brake according to claim 1, wherein said bearing means on said base plate is a pair of upstanding plates symmetrically disposed on said base plate about the longitudinal axis of said ski and arranged at an acute angle to the longitudinal axis of said ski, which acute angle is a diverging angle away from said free ends of said brake leg portions.

5. The ski brake according to claim 1, wherein said bearing means on said base plate is a pair of upstanding plates symmetrically disposed on said base plate about the longitudinal axis of said ski, each of said upstanding plates having means supporting said brake arms for a rotary movement about an axis of rotation, a lateral movement along said axis of rotation and a pivotal movement about an axis perpendicular to said axis of rotation.

6. The ski brake according to claim 2, wherein the orientation of said diverging angle and said axis of said axle pins effects said lateral movement of said brake arms over the upper surface of said ski only when said pedal portion and said brake leg portion are both oriented above the upper surface of said ski.

7. The ski brake according to claim 1, wherein said resilient means includes a leaf spring secured to and extending between said control part and said base plate to continually urge said brake arms and said control part to said initial position thereof.

8. A ski brake for use on a ski, comprising:

a base plate adapted to be mounted on said ski;

bearing means on said base plate;

a pair of laterally spaced brake arms pivotally and laterally slidably mounted on said bearing means, each of said brake arms being made of wire and having a brake leg portion extending in the same direction as and being oriented offset to a pedal portion, said brake arms and said pedal portion being integrally connected by an axle segment extending between mutually adjacent ends of said brake arms and said pedal portion, said brake arms each being pivotal about said axle segment between (1) a braking position wherein said brake leg portions project beneath the running surface of said ski and said pedal portion extends upwardly inclined to the upper surface of said ski and (2) a retracted position wherein said brake leg portions and said pedal portion extend above said upper surface of said ski and said brake leg portions are oriented inwardly of the lateral edges of said ski;

a control part and pivotal securement means pivotally securing said control part to said pedal portions of each of said brake arms, said pivotal securement means effecting, upon a pivotal movement of said control part relative to said pedal portions between an initial position wherein said brake arms are positioned in their laterally outermost position and a final position wherein said brake arms are positioned in their laterally innermost position, a laterally inward movement of said brake arms, said axle segments of said brake arms extending in a common plane in both said braking position and said retracted position, said axle segments further extending at an acute angle to each other and to a plane extending centrally of said ski, parallel to the longitudinal axis of said ski and perpendicular to the upper surface of said ski in both said braking and retracted positions; and resilient means effecting an erection of said brake arms to said braking position and a simultaneous urging of said control part to said initial position thereof to urge said brake arms to their said initial position thereof.

9. The ski brake according to claim 8, wherein said pivotal securement means consists of a pivot axis fixedly oriented between said control part and each said pedal portion for effecting a pivotal securement of said control part to each said pedal portion.

10. A ski brake for use on a ski, comprising:

a base plate adapted to be mounted on said ski;

bearing means on said base plate;

a pair of laterally spaced brake arms pivotally and laterally slidably mounted on said bearing means, each of said brake arms having a brake leg portion and a pedal portion, said brake arms each being pivotal between (1) a braking position wherein said brake leg portions project beneath the running surface of said ski and said pedal portion extends upwardly inclined to the upper surface of said ski and (2) a retracted position wherein said brake leg portions and said pedal portion extend above said upper surface of said ski;

a control part and pivotal securement means pivotally securing said control part to said pedal portions of each of said brake arms, said pivotal securement means effecting, upon a pivotal movement of said control part relative to said pedal portions between an initial position wherein said brake arms are positioned in their laterally outermost position and a final position wherein said brake arms are positioned in their laterally innermost position, a laterally inward movement of said brake arms, said control part having an upwardly facing surface with said pivotal securement means downwardly extending from an underside thereof adjacent the lateral edges of said upwardly facing surface, said pivotal securement means effecting said pivotal coupling to said pedal portions about separate axes, said axes of said pivotal securement means extending parallel to said plane of said upwardly facing surface and opening at a diverging angle toward the free ends of said brake leg portions; and resilient means effecting an erection of said brake arms to said braking position and a simultaneous urging of said control part to said initial position thereof to urge said brake arms to their said initial position thereof.

* * * * *